US008616131B2

(12) United States Patent
Kaddour et al.

(10) Patent No.: US 8,616,131 B2
(45) Date of Patent: Dec. 31, 2013

(54) RUPTURING DEVICES

(75) Inventors: Abdul-Salam Kaddour, Farnborough (GB); John Cook, Sevenoaks (GB)

(73) Assignee: Qinetiq Limited, London (GB)

( * ) Notice: Subject to any disclaimer, the term of this patent is extended or adjusted under 35 U.S.C. 154(b) by 172 days.

(21) Appl. No.: 12/452,846

(22) PCT Filed: Jul. 9, 2008

(86) PCT No.: PCT/GB2008/002351

§ 371 (c)(1), (2), (4) Date: Jan. 25, 2010

(87) PCT Pub. No.: WO2009/013456

PCT Pub. Date: Jan. 29, 2009

(65) Prior Publication Data

US 2010/0126887 A1 May 27, 2010

(30) Foreign Application Priority Data

Jul. 25, 2007 (GB) ..... 0714440.5

(51) Int. Cl.
*F41A 9/00* (2006.01)

(52) U.S. Cl.
USPC ..... 102/481; 102/377; 89/1.14; 86/50

(58) Field of Classification Search
USPC ..... 102/377; 89/1.14; 86/50
See application file for complete search history.

(56) References Cited

U.S. PATENT DOCUMENTS

| | | | | |
|---|---|---|---|---|
| 3,887,991 A | | 6/1975 | Panella | |
| 4,035,007 A | | 7/1977 | Harrison et al. | |
| 4,501,058 A | * | 2/1985 | Schutzler | 29/446 |
| 4,743,079 A | * | 5/1988 | Bloch | 439/161 |
| 5,036,658 A | | 8/1991 | Tate | |
| 5,044,154 A | | 9/1991 | English, Jr. et al. | |
| 5,060,470 A | | 10/1991 | VanName | |

(Continued)

FOREIGN PATENT DOCUMENTS

| | | |
|---|---|---|
| DE | 30 07 307 | 7/1981 |
| DE | 101 15 950 | 3/2001 |

(Continued)

OTHER PUBLICATIONS

International Preliminary Report on Patentability dated Jan. 26, 2010 for PCT/GB2008/002351.

(Continued)

*Primary Examiner* — Samir Abdosh

(74) *Attorney, Agent, or Firm* — Nixon & Vanderhye P.C.

(57) ABSTRACT

The invention provides rupturing devices for mitigating the explosive reaction of a casing (121), hollow tubular body or container, particularly a munition, when it is subject to an external thermal hazard threat. The devices are based on the use of shape memory alloys. The device comprises an element of shape memory alloy (123) which is joined together by a connector (122) to form an annulus, which may be located on an exterior surface of a munitions casing (121) or launch such that upon heating through its transition temperature range will cause the annulus to contract radially inwardly, thereby rupturing the munition (121), allowing any build up of pressure to be released quickly. Advantageously, the connector (122) is. reversible such that the device will be capable of being retro-fitted or removed during normal servicing of the munition (121).

17 Claims, 14 Drawing Sheets

(56) References Cited

U.S. PATENT DOCUMENTS

| | | | | |
|---|---|---|---|---|
| H1144 | H | 3/1993 | Cherry et al. | |
| 5,361,703 | A | 11/1994 | Braithwaite | |
| 5,376,001 | A * | 12/1994 | Tepper | 433/6 |
| 5,394,803 | A | 3/1995 | Mort | |
| 5,562,678 | A * | 10/1996 | Booker | 606/113 |
| 5,643,281 | A * | 7/1997 | Suhocki et al. | 606/113 |
| 5,735,114 | A | 4/1998 | Ellingsen | |
| 6,019,025 | A | 2/2000 | St. Amand | |
| 6,321,656 | B1 | 11/2001 | Johnson | |
| 6,450,725 | B1 | 9/2002 | Roth et al. | |
| 6,780,260 | B1 * | 8/2004 | Goldstein et al. | 148/563 |
| 7,051,511 | B2 | 5/2006 | Prytz | |
| 7,549,375 | B2 * | 6/2009 | Cook et al. | 102/377 |
| 2004/0015179 | A1 * | 1/2004 | Monassevitch et al. | 606/153 |
| 2004/0244358 | A1 | 12/2004 | Prytz | |
| 2004/0247386 | A1 * | 12/2004 | Sugiyama et al. | 403/408.1 |
| 2005/0115443 | A1 * | 6/2005 | Rastegar et al. | 102/400 |
| 2006/0054046 | A1 * | 3/2006 | Cook et al. | 102/481 |

FOREIGN PATENT DOCUMENTS

| | | |
|---|---|---|
| EP | 0 004 696 | 10/1979 |
| EP | 0 310 369 | 4/1989 |
| EP | 0 334 731 | 9/1989 |
| EP | 0 738 869 | 10/1996 |
| EP | 1 808 664 | 7/2007 |
| FR | 2 686 410 | 7/1993 |
| FR | 2 742 221 | 6/1997 |
| GB | 2 352 768 | 2/2001 |
| JP | 63-72062 | 4/1988 |
| JP | 5-99377 | 4/1993 |
| JP | 5-322074 | 12/1993 |
| JP | 8-189510 | 7/1996 |
| JP | 2000-106060 | 4/2000 |
| SU | 1590802 | 2/1988 |
| WO | WO 90/12237 | 10/1990 |
| WO | WO 02/03019 | 1/2002 |
| WO | WO 02/03019 A1 | 1/2002 |
| WO | 2004/015360 | 2/2004 |
| WO | 2005/012397 | 2/2005 |
| WO | 2005/113121 | 12/2005 |

OTHER PUBLICATIONS

International Search Report for PCT/GB2007/003431, mailed Jun. 25, 2007.

Written Opinion of the International Searching Authority for PCT/GB2007/003431, mailed Jun. 25, 2007.

GB Search Report for 0714440.5, Nov. 9, 2007.

* cited by examiner

RUPTURING DEVICES

This application is the U.S. national phase of International Application No. PCT/GB2008/002351, filed 9 Jul. 2008 which designated the U.S. and claims priority to Great Britain Application No. 0714440.5, filed 25 Jul. 2007, the entire contents of each of which are hereby incorporated by reference.

The present invention relates to rupturing devices based on shape memory alloys, to equipment provided with such devices and to methods of deploying said devices. A particular application for such devices is rupturing a munition casing in order to help avoid or at least to mitigate an explosive reaction, when such munition is inadvertently exposed to fire or some other source of heat.

The present invention is concerned with the use of shape memory alloys (SMAs) to provide means for mitigating against the violent explosive reaction of a munition when it is heated to the ignition temperature of the energetic material. The most extreme condition occurs when the rate of heating is very slow, the so-called "slow cook-off" condition. Under these circumstances, the whole munition reaches an almost uniform temperature so that the casing surrounding the energetic material is unlikely to lose very much strength before the point at which the energetic material finally ignites. At this point there is a rapid pressure build-up and a high order explosion or even a detonation occurs. Faster heating, which occurs, for example, when the munition is exposed to a fuel fire (a so-called "fast cook-off" condition) is less hazardous and easier to counter. In this situation, because a high temperature gradient is set up from the outside of the munition to the inside, the casing will reach a higher temperature than the energetic material and so will weaken before the energetic material ignites. It is possible to enhance this beneficial weakening effect by choice of case materials and by the use of thermal insulation (which is usually needed anyway) between the case and the energetic material. Although the present invention is concerned with mitigating both fast and slow cook-off, the emphasis is on the latter because of the lack of alternative measures for meeting this situation.

There have been a number of disasters over the last 40 years, involving ships, magazines and weapon storage depots in which much loss of life and military equipment have been incurred. Alarmingly, many of them have occurred during peace time, and, of those that have occurred in wartime, many have not been the result of enemy action.

Slow cook-off events have typically occurred where there is a fire in a compartment next to a magazine that burns for many hours with the result that the magazine heats up slowly and all the explosive stores within it increase in temperature very slowly and uniformly. Therefore, when the first particle of energetic material reaches its spontaneous ignition temperature (T of I), probably in the range 125° C. to 200° C., the remainder is also on the verge of igniting. Furthermore, at that temperature the munition casing would retain nearly all of its strength, particularly when made of steel. The result of slow cook-off can be a high order explosion that can, for example, destroy a ship. Two famous examples of disasters initiated by fires are HMS Sheffield in the Falklands War and the USS Forrestal in the Vietnam War, both of which resulted in large numbers of casualties and loss of platforms, systems and munitions.

As a result of these and other incidents, the subject of Insensitive Munitions (IM) has become an important one in the design, procurement, storage and deployment of any weapons system that employs propellants or explosives, that is most weapons.

Applicant's earlier patent application, WO 2004/015360, describes a rupturing device for venting a munitions casing using an annulus formed of complete loops of wires or solid bands of a SMA alloy.

According to a first aspect of the invention there is provided a rupturing device suitable for rupturing a casing, hollow tubular body or container, comprising at least one SMA element which is connectable, by at least one connector to form an annulus, wherein said shape memory alloy has been subjected to a combination of mechanical and thermal treatments and has a selected composition such that upon subsequent heating, in use, to a predetermined temperature, said annulus is capable of contracting along its length to provide a rupturing function.

The annulus, when located around the periphery of a piece of equipment to be ruptured, and when caused to function, contracts along its length, i.e. circumference and hence radially inwardly towards the centre of the piece of equipment, thereby causing rupturing of said equipment.

The equipment may be a casing, hollow tubular body or container; particular use for the rupturing device may be found when the casing or container is a munition casing, launch-tube or platform for a munition. According to a further aspect of the invention there is provided equipment comprising a casing, hollow tubular body or container and a rupturing device according to the invention wherein the device is mounted around a periphery of said casing, hollow tubular body or container and is connected to form said annulus, and is adapted such that upon subsequent heating, in use, the annulus contracts (radially) inwards to rupture said casing, hollow tubular body or container.

When a munition is in storage it may be difficult to gain access to individual munitions. This may be especially difficult when munitions are stored in a stacked arrangement. Therefore, where it is necessary to retrofit a rupturing device, rather than removing individual munitions from storage and directly attaching an annulus around the munition casing, it is possible to retrofit the present device in-situ. A further advantage of forming the annulus in-situ is that the munition need not be removed from active service to allow the device to be fitted. A yet further advantage is that the precision engineering, tensioning and machining of the at least one SMA element, may be performed offsite by skilled engineers. The second step of locating and securing the device to the munition may be performed by a technician without needing special expertise in an ordnance depot or in the field of military use.

Memory or conditioning may be imparted into a shape memory alloy, in such a way, that upon heating there is contraction in the length of said at least one SMA element. During operation of the device according to the invention, a change in crystalline state of the shape memory alloy, brought about by heating, causes a contraction in the length of the at least one SMA element, which in turn, causes a contraction in the overall circumference of the formed annulus, thereby causing the overall effect of inward radial contraction of the annulus.

Where the connector does not itself undergo any change in crystalline state during operation, contraction of the annulus is only provided by the action of the at least one SMA element. However, the action of the at least one SMA element causes the complete annulus, i.e. connector and SMA element, to reduce in its overall circumference. Therefore, even where the connector is effectively inert and does not undergo any change of state, the complete annulus will still move radially inwards.

By the term "munition" as used hereinafter is meant a bomb, warhead or rocket motor or any similar device which contains a gun propellant, a rocket propellant or an explosive or other energetic material housed within a casing.

The term "munition casing" refers to, an output or payload section, a propellant housing, or an external casing such as a launch tube or any part of the munition system, which when ruptured would permit venting of gases and mitigate the chances of a high order reaction, such as detonation or explosion.

By the term "annulus", is meant a complete and continuous band or ring. This may flex to substantially adopt the shape of the outer periphery of the container, hollow tubular body, casing, such as, for example munition casing to be ruptured. The annulus may be in continuous contact around the periphery or may merely contact said periphery at selected intervals or even be suspended above the surface of said periphery, preferably the annulus is in intimate contact with the container, hollow tubular body or casing. Most containers or hollow tubular bodies, such as, for example, pipes, or casings are generally circular in their cross section. Therefore, the annulus will usually be substantially circular in its cross section. By the phrase "radially inwardly" is meant movement towards the centre point of the annulus.

The at least one SMA element may be comprised of a solid cross section, hollow-tubular section or any other suitable section shape of shape memory alloy. Alternatively, the SMA element may be comprised of at least one wire, preferably a plurality of wires. The wires may be in the form of a plurality of single strands, a continuous loop or coil, or alternatively they may be intertwined or braided to form a rope like structure that is capable of maintaining its integrity during the assembly process, and which may additionally impart further strength to the annulus. It may be desirable to incorporate wire made from different shape memory alloys or even non-shape memory alloys, such as metals, alloys, fibres to provide a composite annulus.

The at least one SMA element may be a length of wire or length of rod or tubing, which can be joined by a connector to form an annulus. The annulus may be pre-shaped to adopt the configuration of the outer surface of the equipment to be ruptured. One advantage of using a shape memory alloy in the form of a wire is that it easily adapts and configures to the external peripheral shape of the equipment to be ruptured, without any pre-shaping.

In a preferred embodiment, the at least one SMA element is itself a coil or loop of a plurality of shape memory alloy wires, the loop is stretched out to form two lengths side-by-side with two opposite ends, the opposite ends are brought together and said connector joins the two opposite ends, to form said annulus. The loop of wire may be a continuous coil of a single strand of wire or a plurality of single strands, which may extend around the perimeter of the casing, such that, in use two elongate sections of the loop may be located on a peg or protrusion to form the annulus.

The elongate SMA element may be a single length of SMA alloy or may comprise a plurality of interconnected SMA lengths to form said elongate SMA element, which may include non-SMA linkages there between (which linkages may be fixed or connectable/disconnectable).

The annulus may comprise a plurality of shape memory alloy elements or links which are joined together by at least one connector, such as to form a chain-like structure. It may be desirable to add or remove links to increase or decrease respectively the length of the chain. In one embodiment the links may be formed like a chain necklace, wherein each link is preformed and interlinked with its neighbouring link during manufacture. The resulting chain may be cut to length and joined with an appropriate connector. In an alternative arrangement each link may be assembled, such as, for example, like a bicycle chain, wherein each link is comprised of at least two components, such that links may be added or removed with simple tooling. The links are engineered such that the overall length of the chain decreases upon subsequent heating to the predetermined temperature, such as to cause inward radial contraction of the annulus.

The connector may in one embodiment comprise at least one operative part and at least one co-operative part that are connectable together and that are each integrally provided at the respective ends of the SMA element. This provides the advantage that no further components are required to make the connection as all component parts are present on the SMA element to form the annulus. In one embodiment, the connector may be formed by machining part of the SMA element itself. Alternatively, at least one fixing may be attached to one or both the ends of the SMA element, said fixing forming the connector to allow connection of the SMA element to form the annulus.

In an alternative embodiment, the connector may comprise two end sections that are each integrally provided at the respective ends of the SMA element and an interconnecting middle section having respective end portions that are connectable to said respective two end sections to form said annulus.

In a further alternative, the connector may be discrete (i.e. a separate one-piece article) and have integral fixing points which are capable of connecting together at least two parts of the at least one SMA element to form said annulus, such as, for example a machine head type connector or skein connector. In the machine head arrangement a wire, or loop or coil of wires may be attached to the machine head without any modification or further processing of the SMA element. Connectors that are adapted to connect a skein or loop of wires are preferred, partly because of the inherent robustness of such arrangements.

The use of the term "connector" shall hereafter be taken to include discrete connectors, connectors which form an integral part of the equipment to be ruptured, integral co-operative and operative two-part connectors, or a connector where a interconnecting middle section is required, thus forming a three-, or more, part connector.

The operative and co-operative parts of the connector respectively may comprise one or more projections and one or more complementary recesses. As an example, the one or more projections may comprises at least one tongue, lug, latch, bolt, wedge, pin, lip, hook, male threaded portion or any other form of protrusion which will form a locking engagement with a complementary recess.

Examples of the one or more complementary recesses comprise a pocket, groove, channel, loop or female threaded portion. In one embodiment the operative and co-operative parts may possess complementary threads. By way of an example only, the connector means may posses two male threaded portions and an interconnecting middle section, such as, for example a sheath or collar, which comprises a complementary female thread, or vice versa.

In an alternative, less preferred embodiment, the connector may be provided by a welded, soldered or adhesively bonded joint.

In one embodiment the connector may be made from or comprise a portion of shape memory alloy. The activation temperature of the shape memory alloy in the connector may be substantially the same or different to that in the at least one SMA element. The activation temperature of the shape memory alloy which forms part of the connector may provide a further means of imparting the required tension to the device, such that the device is self tensioning (as hereinafter defined).

The connector provides robust connection of two ends of an SMA element (either the same length of SMA or a further length of SMA), or the robust connection of at least two points on a looped SMA element, to form an annulus. The connection or joint must be strong enough such that the force of the contraction of the SMA element does not compromise the connector.

The connector may form a locking engagement, such as, for example, a snap-fit type arrangement or a compression type fitting, such as, for example, a screw thread etc, to form a secure annulus.

One drawback of prior art mitigation devices is that once the shape memory alloy device has been attached to the munition it may form a permanent, structural or even integral part of the system. Therefore a mitigation device, which is wound or located directly onto the casing or forms an integral, especially internally mounted, part of the casing may not be easily removed without first breaking-down the munition or destroying the annulus. Therefore, in a particularly preferred embodiment the joint formed by the connector may be disengageable such that the join or connection is reversible, to provide a removable rupturing device. This may provide particular advantage where the munition cannot be easily stored, transported or deployed with a retrofitted rupturing device, due to interference with other components.

During extreme operational temperatures, such as those experienced at gun launch or during the flight of a munition, there may be a small risk that low-melt alloy systems or permanently fitted shape memory alloy systems may start to function and cause unwanted failure of the munition. Therefore the removal of the device prior to deployment provides the advantage of inadvertent activation during deployment. Furthermore, this allows the shape memory alloy to be selected, such that it may have a lower activation temperature, as it would not also be required to withstand operational temperatures. The activation temperature would only need to exceed the maximum temperature experienced during storage and transport. This would allow a greater selection of shape memory alloy materials to be used and allow the activation temperature to be reduced.

Where the munition has a uniform or tapered diameter it may be possible to provide the mitigation device as a complete annulus such that can be slid into position from one end of the munition and subsequently retained in position via the connector.

Alternatively, to facilitate the location of the device around the munition, the SMA element may be preformed in the shape of a part annulus (or broken annulus) of a shape memory alloy, which is joined by at least one connector to form the annulus. The part annulus may itself be hinged at one or more points or may be substantially the same diameter as the munition, such that the part annulus may be slid onto the end of the munition. Conveniently, the termini of the part annulus may comprise the connector and may comprise operative and co-operative parts or require use of a interconnecting middle section as hereinbefore defined.

The at least one SMA element and/or the shape memory alloy which may form part of connector may be selected from any ductile shape memory alloy, preferably Cu—Al—Zn, Cu—Al—Ni, Cu—Ni—Al—Zn—Mn, Cu—Zn—Al—Mn and Ti—Ni alloys. The SMA element will preferably be selected to have an activation temperature, i.e. metallurgical transition commonly referred to as switching temperature, which permits the device to function below that of the cook off temperature of the energetic material, so as to allow venting of gases to help mitigate against the effects of a high order reaction.

The transition temperature of a Ti—Ni shape memory alloy can be adjusted by varying the proportions of Ti and Ni. Other elements may be added to Ti—Ni to adjust the transition temperature or achieve better mechanical properties. These include Nb or Hf in the range of less than 10% and Cr, Fe or Ce in the range of less than 2%. For situations where the device is to remain affixed to the monitor during deployment, the transition temperature must be higher than the highest temperature incurred in normal service, which may typically be between 50° C. and 110° C., depending on the storage and service conditions, but below the lowest temperature at which slow cook-off can occur. This cook-off temperature can be as low as 125° C. for some classes of propellant but well over 200° C. for some pyrotechnic compositions. The transition temperature of the shape memory alloy may increase if it is contracting against a resistive load and this effect can be exploited to "fine tune" the activation temperature of the device.

The aperture produced by the action of the device according to the invention on a casing or container such as, for example, a munition may not be a full peripheral aperture, i.e. one which extends around the entire periphery effectively causing the casing or container to split into two separated parts. For most applications the aperture will be sufficiently large to produce the desired level of mitigation of the hazard. The area of the aperture required to minimise a high order event for an energetic material enclosed in a munition casing will depend on many factors such as the type of energetic material used, degree of confinement etc, this information may be readily obtained by the skilled energetic material modeller. Similar data for pressurised containers would also be available, to the skilled engineer.

The device may be configured such that contraction of the formed annulus causes buckling, which may crack or delaminate the munition casing. If there are joins or areas of weakness on the surface of the munition (due to manufacturing techniques), it may be desirable, (for example, in the case of a layered laminated casing) to incorporate a stress raiser between the annulus and munition to increase further the pressure exerted on that particular point of the munition casing.

As an example, if the casing is a monolithic metal a buckling failure mode may be induced by forming one or more deep folds, which possess sharp radii of curvature at the root of each fold. If the strain in these regions exceeds the breaking strain of the metal then cracking will occur. Alternatively, if the casing is of laminated construction, for example steel strip laminate, it will delaminate followed by buckling. The incorporation of a stress raiser may facilitate the mode of buckling. Therefore the device preferably further comprises a stress raiser located between the annulus and the casing, hollow tubular body or container and arranged, such that in use, the radially inward force exerted by the annulus is concentrated onto a small area of the casing, hollow tubular body or container. Particularly for munitions casings and their launch tubes, the device may comprise a stress raiser located between the annulus and the munition casing and arranged, such that in use, the radially inward force exerted by the annulus is concentrated onto a small area of the munitions casing, via the stress raiser.

In one arrangement it may be desirable to incorporate at least two stress raisers between the annulus and the casing, hollow tubular body or container, so as to give rise to greater total radial inward displacement compared to a single stress raiser. In a preferred option the stress raisers are rods; these can be located between the SMA annulus and the casing. In an alternative arrangement where the SMA is in the form of wire windings, the stress raisers may be located between adjacent wire windings. For a monolithic casing the inward force exerted by the stress raiser causes the casing to flatten locally and eventually assume negative curvature. From that point the casing will be unstable and buckle. If there are joins or seams in the casing (as is the case with steel strip laminate) then it may be advantageous to place the stress raiser along a seam. In general, the intention is to buckle a significant length of the casing, so that the "pressure" exerted by the contracting annulus is distributed over a small area of casing. In these circumstances the vent may occur as a longitudinal crack or it may appear at a closure or stiff ring at the end of the buckled region, i.e. at the junction between the buckled and unbuckled zones.

It will be apparent to the skilled man that equipment such as casings, hollow tubular bodies or containers that are made from malleable materials may not be so easily buckled to the point where there is a split or aperture created in the surface of said material, in which case a shearing action on the munition casing may be advantageous.

In a preferred embodiment the stress raiser is a cutter which may be located between the annulus and the munition and is arranged, such that in use, the radially inward force exerted by the annulus is concentrated via the cutter onto a relatively small area of the munition casing thus forming one or more apertures or slots within the munition. Preferably the cutter is an element which comprises at least one cutting edge, such as for example a sharpened edge, spike or blade. The cutting edge of the blade may be shaped to any commonly used profile, such as, for example, a point, chisel edge, shouldered edge, v shaped or vv shaped. It will be readily appreciated by a person skilled in the art as to the size of aperture required to allow the explosive to be mitigated in any particular munition. In a preferred embodiment there is a plurality of cutters provided so as to cause a plurality of apertures in the munition casing.

The size of cutting device may then be selected to create the desired size of aperture. As an example with regards to rocket motors, the venting via the aperture reduces the severity of the response to thermal threats, as it does for other types of munition, but there is the additional advantage that the degree of propulsiveness is greatly reduced. This reduces the likelihood of munitions being propelled during a hazardous event in a confined area such as, for example an ordnance depot or magazine.

When a cutter is used there may be an increased risk of the cutting edge accidentally piercing the munition casing, particularly if the device receives an impact, is dropped or is subjected to a large force. Therefore, it may be desirable for the cutting edge to be retained in a retracted position prior to use, such that it is not in direct contact with said casing. The retracted position may be caused by means of a sacrificial spacer, a bias means, sacrificial retaining pins or a shearable adhesive bond. In a preferred embodiment the retracted position may be provided by the use of a sacrificial spacer formed from a low melt alloy (eutectic alloy), which preferably has a melting point below that of the activation temperature of the shape memory alloy. In an alternative arrangement the eutectic alloy may be selected so that it melts at a temperature which is above the transition temperature of the SMA. The cutters would then press against the eutectic alloy spacers until the alloy softened or melted away. Thus the activation of the device may then in part be controlled by the melting temperature of the alloy, which may be used to increase the activation temperature of the rupturing device.

If the SMA element is solid in cross section or hollow tubular in cross section then preferably it is pre-formed to the external shape of the munition, such that the final formed annulus may be readily located on the surface of the munition. Preferably the SMA is in the form of a wire. Accordingly the munition may be provided with an SMA element in the form of a wire, which wraps one or more times around the perimeter of the munition, and the respective ends of said wire are connectable by a connector, such that said formed annulus comprises at least one coil of shape memory alloy wire. In a preferred embodiment a plurality of SMA wires are located substantially all the way around the exterior surface of the munition and are connectable by a connector to form an annulus. However, strands of wire may have a tendency to spread out laterally when unconfined, so preferably the rupturing device comprises an SMA element in the form of a wire, and further comprises a housing within which the wire is wound, said housing being located around at least part of the periphery of the casing, hollow tubular body or container. In a preferred embodiment there may be one or more cutters or stress raisers located in the base of the housing. These may be present as an integral cutter or as a plurality of cutting inserts.

In the example, the wire is located abutting and behind the cutting edges, such that in use, both the wire and the cutting edges are retained within the walls of the housing. The housing and wire may be located as a complete unit and joined using the connector or it may be added in a stepwise manner, i.e. placing the housing with optional cutter on the munition casing and then locating and forming the rupturing annulus assembly as hereinbefore defined within the housing.

The housing may extend part, substantially all or completely around the perimeter of the munition casing either on its own, or when joined to one or more of the connectors. This may depend on the selected type of connector used to form the annulus and also on the number of cutting edges required.

The housing may be any cross section such as for example U-shaped, rectangular cross section, V- or VV-shaped; the latter two examples may themselves provide a cutting edge. The housing may be used to locate the wires and cutters relative to the munition casing, in which case a rectangular profile is preferred, with the cutters free to move radially inwards in slots or holes within the housing. The housing may also contain a cover to afford protection to the wire, or alternatively the wire may be potted-in the housing with a suitable potting compound.

Conveniently, the walls of the housing may be cut or scored to provide reduced flexural stiffness, such that in use, the radial contraction of the device is not expended on deforming the housing. In a preferred embodiment the housing is formed from a plurality of housing elements that are linked together so as to form a flexible housing arrangement, which is locatable around the perimeter of said casing, hollow tubular body or container. The linked sections of housing form a bracelet type arrangement, which houses the wire and stress raisers/cutters in a ready fashion, such that the device may simply be located around a munition, in a similar fashion to fastening a bracelet, wherein the annulus is formed by fastening the connector.

In a further embodiment, part of the housing may be formed from a shape memory alloy such that said housing may contribute further to the rupturing of the munition casing.

The shape memory alloy mitigation devices described up to this point are passive in that they respond to the external heating threat without the need for sensors to detect the threat or energy sources to trigger the shape memory alloy. When used in this way they have the merits of simplicity and obviate the need for additional energetic materials, which introduce fresh hazards, or power sources such as batteries that introduce lifting and maintenance issues.

The device according to the invention may preferably be used in a passive mode, such that the heat required to afford the change arises from the proximate thermal hazard. In an alternative embodiment the heating of the annulus may be afforded by an applied heater or heating means. Internal heating may be afforded by resistive ohmic heating of the annulus, by direct application of a current or by inductive heating. External heating may be provided by a heater located next to the annulus, such as, for example a resistive wire placed in thermal contact with the annulus. Alternatively an external heat source such as RF source or an exothermic chemical heater, such as, for example, a pyrotechnic heat source, may be located, such as to cause heating and subsequent radially inward contraction of the annulus.

Therefore, the activation of the device may be active as well as passive. The active mitigation may find advantage if there is a thermal hazard which is remote from the munition(s), but which may in time progress to a store of munitions. As an example a fire in one part of a ship which is initially remote from the munition magazine may be detected and considered (either automatically or by user intervention) to provide sufficient risk to the munitions stored in the magazine, and thus activation of one or more devices according to the invention may be caused, such that the munitions are made safe in advance of the fire hazard reaching the magazine. Clearly other hazards such as fragment attack for example bullets, projectiles etc may be mitigated against by using an active based system, such that a hazard detected by a remote sensor or operative may activate the devices according to the invention to proactively mitigate the effects of the detected hazard. Furthermore a user may wish to mitigate against the effects of a misfire to render the munition safe.

The advantage of a retrofitable device has been clearly highlighted above, however, there is still a requirement that the final fitted device operates correctly, i.e. is able to rupture the munition. It will be clear that the device needs to be securely fixed to the munition so that it does not fall off or move from a preferred location. To improve performance, the annulus is preferably subjected to further tension once located on the munition, so that substantially all of the force arising from the contraction of the shape memory alloy is directed to rupturing the munition. Tension may be imparted at a minimal level, merely to take up any slack in the annulus or wire, or it may be greater, for example, to elevate the activation temperature of the shape memory alloy or to ensure that the device remains in place on the munition under acceleration loads. Conveniently, there is further provided a tensioner which may be a separate device or may conveniently form part of the connector.

In one embodiment the tensioner comprises a mechanical leverage device to impart tension in said annulus, such that the device remains in intimate contact with the munition casing.

There are many known ways of imparting tension to a rod, tube or wire. Tensioning systems are commonplace and may be readily located on part of the annulus or may form part of the connector. As an example, for a shape memory alloy wire annulus, tension may be imparted by using suspended weights, capstans/machine heads (akin to those used on a guitar), or threaded tensioners, the latter providing connector and tensioning in an integral device. Alternatively, the tension may be provided by a separate or remote device and then locked in position by a clamp such as for example a lockable ball bearing system, such as a modified Gripple® device.

Alternatively, tension may be provided by a pre-stretched or expanded SMA element which forms the annulus at a temperature below the predetermined switching temperature prior to fitting on the munitions casing, such that a minor part of the activation of said shape memory alloy i.e. contraction of said shape memory alloy, firmly locates and grips the device to the munition.

In a further aspect of the invention there is provided a method of applying a rupturing device to a casing, hollow tubular body or container, comprising the steps of locating said SMA element around the periphery of the casing, hollow tubular body or container, and forming an annulus with the connector and optionally applying tension to the SMA element. Preferably the method may be used when the hollow tubular body or container is a munition casing, launch-tube or platform for a munition.

There is further provided a method of controllably rupturing a munitions case comprising the steps of causing heating, to a predetermined temperature, to occur in said at least one annulus, such that in use, said rupturing annulus will contract radially inwardly and rupture said munition casing.

There is further provided a munition, launch tube, transportation holder, platform for a munition comprising at least one device according to the invention.

In one embodiment, the shape memory alloy wire or loop may be wrapped around the munition casing more than once, and connectable by a connector, such that the annulus is formed from at least two turns or coils of wire.

In an alternative embodiment, especially where there is a large diameter munition, it may be advantageous to use at least two connectors and at least two SMA elements to form the annulus. Additionally, for long munitions it may be preferable to have one or more devices according to the invention fitted at different locations along the length of the munition casing. Alternatively, there may be an elongated connector with two or more SMA elements to form two or more annuluses. Conveniently, where a munition also possesses a launch tube, the munition and its launch tube may both be fitted with a device according to the invention.

There is further provided a munition casing having at least one SMA element which is connectable by at least one connector to form an annulus disposed around said casing, which alloy has such a composition and has been subjected to a combination of mechanical and thermal treatments, so as to impart a memory, wherein upon subsequent heating to a predetermined temperature, said memory causes said annulus to contract radially inwardly and rupture the said munitions casing.

There is further provided a munitions casing having at least one SMA element which is connectable by at least one connector to form an annulus, located on a surface of said casing, which alloy has a memory imparted, wherein upon subsequent heating to the transition temperature of the alloy, said memory causes said annulus to contract radially inwardly and rupture the said munitions casing.

There is further provided a kit of parts suitable for rupturing a munition casing comprising optional instructions, at least one SMA element, at least one connector and optionally a housing, optionally a tensioner and also optionally a cutter. Preferably, the at least one SMA element is in the form of a wire, which has been subjected to a combination of mechanical and thermal treatments and which has a composition such that upon subsequent heating to a predetermined temperature will contract substantially along its length. The contraction in the length of the wire, when coiled or present in a loop around the outer surface of a munition casing will cause radially inward contraction of said annulus.

There is further provided a method of producing a shape memory alloy wire, which upon subsequent heating to a predetermined temperature will contract substantially along its length, comprising the step of imparting mechanical stress and heating of said wire.

There is further provided the use of a shape memory alloy wire joined to form an annulus by a connector, for the rupturing of munitions casings.

Although this invention is primarily concerned with means for mitigating the effect of cook-off in relation to munitions, it is also recognised that devices suitable for rupturing munitions casings according to the invention, may also be appropriate for use in other situations. One such area is for the rupturing of pipes or rupturing of containers involved in the carrying or storage of fluids such as natural gas. In the event of a heating hazard the gas could become highly pressurised, which could cause an explosion. However, the (controlled) release of such a fluid would prevent a violent explosion. The device according to the invention should not be seen however to be limited to use in conjunction with hazardous, flammable or combustible fluids as any pressurised fluid which exceeds the pressure of its container can present a hazard.

There is further provided a container or hollow tubular body comprising at least one of the devices according to the invention. It may also be envisaged that devices according to the invention may be located around structural supports of a body, such that in use, the structural integrity of said support body is weakened or caused to fail or separate.

Embodiments of the invention are described below, by way of example only, and with reference to the accompanying drawings in which:

FIG. 1 is a sectional view of a housing located around the circumference of a munition.

FIGS. 2*a* and 2*b* show respective sectional views of a housing containing a plurality of wires, with FIG. 2*b* additionally showing a heater arrangement FIG. 3 is a perspective view of a connector in the form of a skein arrangement which connects together two ends of a loop of shape memory alloy wire.

FIGS. 4*a*, 4*b* and 4*c* are schematic plan views of different respective skein arrangements.

FIGS. 5*a* and 5*b* show alternative two part connectors, while FIG. 5*c* shows a plan view of a tensioning cam arrangement for use in FIG. 5*b*.

FIGS. 6*a* and 6*b* show alternative threaded connectors for joining together lengths of shape memory alloy wire.

FIGS. 7*a* and 7*b* are perspective and side views of a capstan or machine head acting as a connector and a tensioner.

FIGS. 8*a* and 8*b* show plan views of alternative arrangements similar to FIG. 4 but with a tensioner to remove slack from the annulus.

FIGS. 9*a* and 9*b* are respective sectional views of a cutter in the form of a cutting edge, before and after activation.

FIG. 10*a* shows a sectional view, and FIG. 10*b* a plan view of a housing, while FIG. 10*c* shows sectional views at three different points on the housing.

FIG. 11 is a perspective view of a loop arrangement as shown in FIG. 3 provided with a tensioner.

FIGS. 12*a* to 12*f* illustrate one example of a sequence of steps for locating a device according to the invention on a munition.

FIG. 13 shows a cross section view of a stress raiser located between the SMA wire and munition case.

FIGS. 14*a* and 14*b* each show a cross section view of an arrangement of 3 stress raisers on a munition case.

FIGS. 15*a* and 15*b* each show a side view of a hinged section of housing forming part of a bracelet arrangement.

Figure 1:
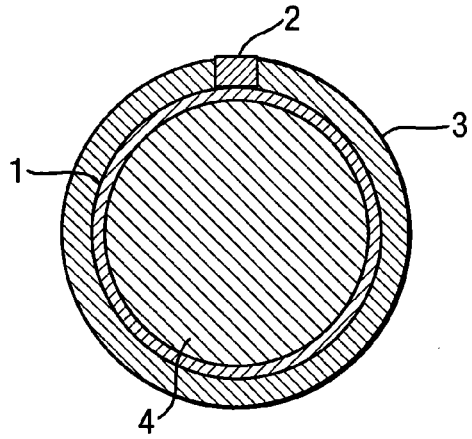

Turning to FIG. 1, there is shown a cross section through a munition casing 1, which encases an energetic material 4. An SMA element is disposed around the perimeter of the munition casing 1 and is joined by a connector 2 to form an annulus or continuous loop, which annulus is adapted to be capable of rupturing the casing 1.

Figure 2A:
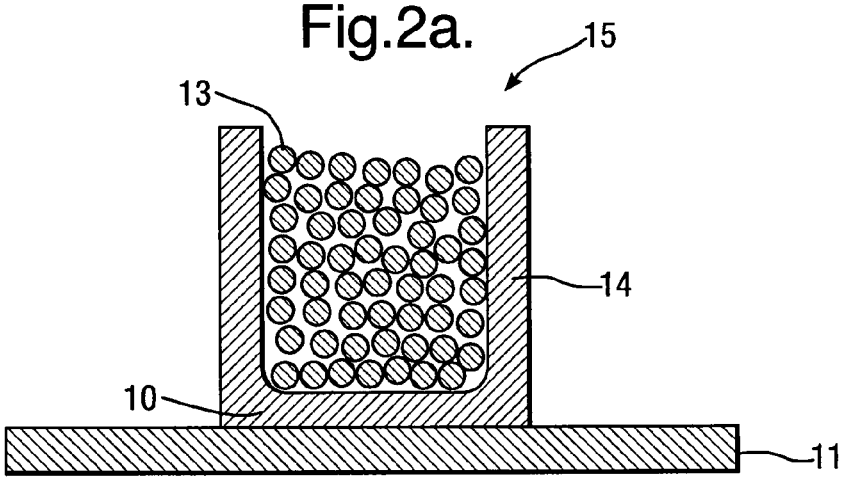

FIG. 2*a* shows a cross section of a housing 15, with side walls 14 and a base section 10 which is in contact with the casing of a munition 11. Within the housing 15 there is a plurality of wire windings 13 of a shape memory alloy. The housing 15 provides a means of retaining the wires 13 in a defined space, such that the radially inward force exerted by the contracting wires 13 is directed to a smaller area. Clearly, housing 15 may also be used to retain a solid or hollow-tubular SMA element. It may be desirable to protect the wires by the use of a cover (not shown) over the housing or by filling the housing with a potting compound.

The SMA wire windings comprise any suitable shape memory alloy composition and are pre-treated in any suitable manner, as will be known to the skilled person in the art. By way of example, a Ti Ni alloy (typical 55% Ni alloy) wire could be used. Such a wire could be pretreated as follows: —

A length of Ti—Ni wire 0.125 mm in diameter, was stretched by 9% to impart a memory and was then cut into 1 meter lengths. Separate lengths were hung vertically with weights of 0.55 Kg (corresponding to a tensile stress of 448 MPa in the wire), 0.75 kg (corresponding to 611 MPa) and 1.00 Kg (corresponding to 815 MPa) suspended from them. The wires passed through an oven which was slowly heated and the resulting recovery compressive strain (under load) measured. Respective length contractions corresponding to recovery strains of 7.1%, 5.9% and 4.9% were recorded, showing that considerable displacements can be achieved even when the stress opposing the contraction of the wire is as high as 815 MPa.

A series of tests were carried out on commercially available Ti Ni shape memory alloy wire to measure the force and stroke needed to cut the various types of tube that were of interest.

The stress-strain relationships for wires stretched (to impart 'memory') at a variety of loads were conducted and the tests were carried out in a tensile testing machine.

The behaviour was found to be highly non-linear, with a long 'plateaus' followed by a stage that is similar to work hardening. Upon unloading the behaviour is also non-linear. There is a general trend for the recovery strain to increase with the peak applied load but for the Ti Ni wire it was found to level out at around 1000 MPa. Clearly, different diameters and/or different shape memory alloy compositions possess different properties. In our example, the largest applied load was (1100 MPa) and it was noticed that occasional wire breaks occurred.

In a rupturing device, the annulus and/or cutters may meet considerable resistance as they drive into the body to be ruptured, it is clear that some resistive force will be transmitted to the contracting wire. A series of tests were undertaken to measure how the wire behaves as it contracts against a load.

The results showed that as the resistive load increases the recovery strain reduces and the transition temperature increases. These results indicated that is would be possible to obtain activation at temperatures as high as 150° C. It is therefore possible to 'fine tune' the activation temperature of a device by controlling the stress that the contracting a wire has to work against.

Figure 2B:
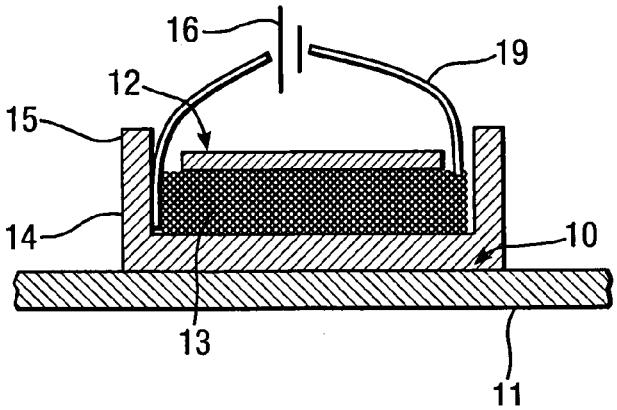

FIG. 2*b* shows a cross section of a housing 15, with side walls 14 and a base section 10 which is in contact with the casing of a munition 11. Within the housing 15 there is a plurality of wire windings 13 of a shape memory alloy. The housing 15 provides a means of retaining the wires 13 in a defined space, such that the radially inward force exerted by the contracting wires 13 is directed to a smaller area. There is also shown a heater arrangement, wherein a heating wire 19 is connected to a power source 16 which is in direct electrical contact with part or all of the SMA wires 13. As the current flows through the SMA wire 13, ohmic resistive heating will occur and when sufficient current is passed along the wire it will heat up the SMA to its transition temperature and bring about a change in memory and hence contract the length of the SMA wire 13. In an alternative arrangement the heating wire 19, may not be electrically connected to, but in thermal contract with the SMA wire 13, but may just be co-wound with the wire or wound on the surface of the SMA wire 13. In this arrangement the wire 19 is merely acting as a source of heat to heat the SMA wire 13.

In a yet further arrangement there is provided a heating element 12, which is in thermal contact with the SMA wire 13. The heating element may generate heat by an exothermic reaction, such as, for example a pyrotechnic reaction, or by an electrical heating element. The heater means, either the wire 19 or heating element 12, may be actively switched on by sensors which detect a hazard, or may be activated manually by an operative.

Figure 3:
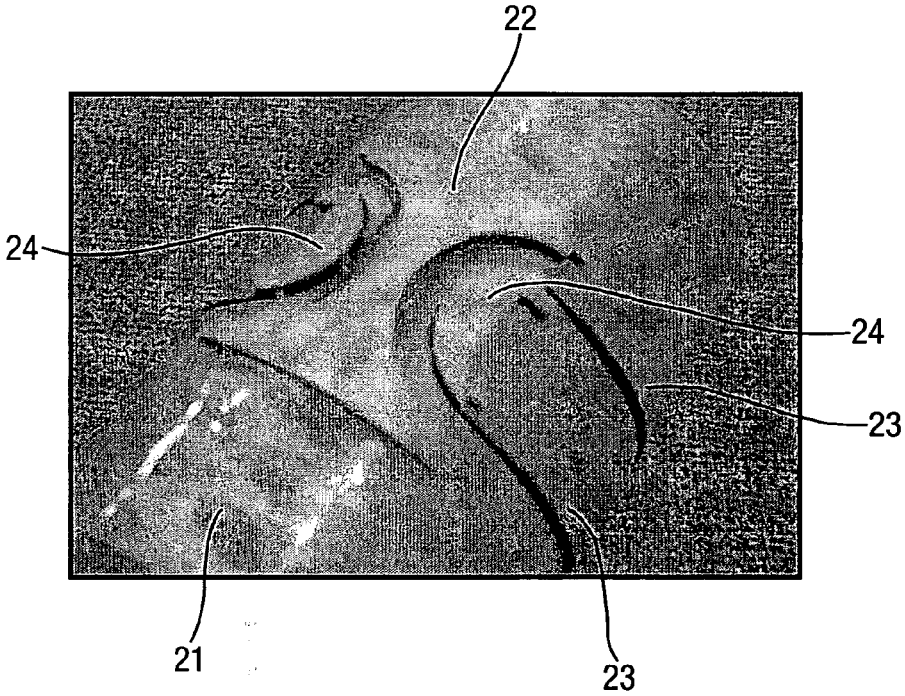

FIG. 3 is a perspective view of a section of a munition casing 21 made from glass fibre reinforced polymer. A connector 22 is located on the outer surface of casing 21. The connector 22 comprises two lugs 24, preferably possessing a rounded shape to reduce excessive wear or stress. The lugs 24 are each designed to retain the two respective ends of a continuous loop of shape memory alloy wire 23, such that the loop 23 and connector 22 form an annulus. The loop 23 may be formed from a plurality of single strands welded together or may more simply be a coil of wire with the ends of the coil firmly affixed to prevent unravelling of the coil. The advantage of using the above arrangement is that the loop of shape memory alloy 23 may receive the required heat treatment and pre-tensioning in a skilled workshop. The pre-tensioned wire may then be simply located around the munition and joined together by the connector, by an unskilled technician. The technician does not need to control the winding of the wire onto the casing 21.

Figure 4A:
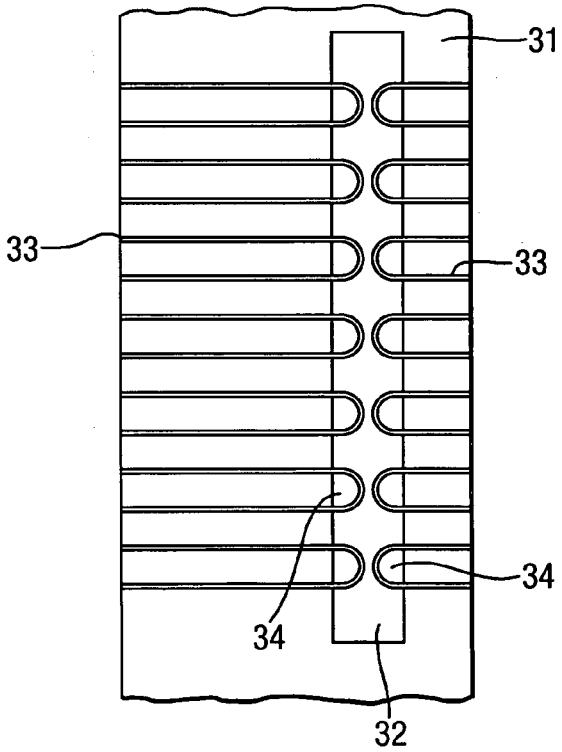

FIG. 4*a* shows an elongated connector 32 mounted on a munition casing 31 similar to that shown in FIG. 3. There are provided a number of lugs 34, which are designed to retain respective loops of shape memory alloy wire 33, which are spaced along the casing's length. The advantage of using a number of adjacent mounted annuli is that if you are trying to induce buckling, then the application of a larger force across a greater portion of the munition casing 31 will afford increased structural damage to the casing. Alternatively a similar effect may be achieved by using one or more separate connectors as shown in FIG. 3.

Figure 4B:
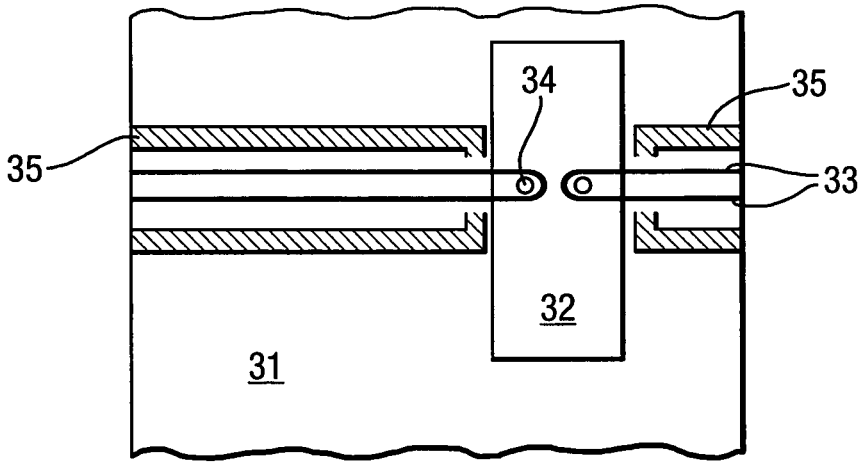

FIG. 4*b* shows the same arrangement as above, except that the loop of shape memory alloy wire 33 is retained in a housing 35 similar to that shown in FIG. 2.

Figure 4C:
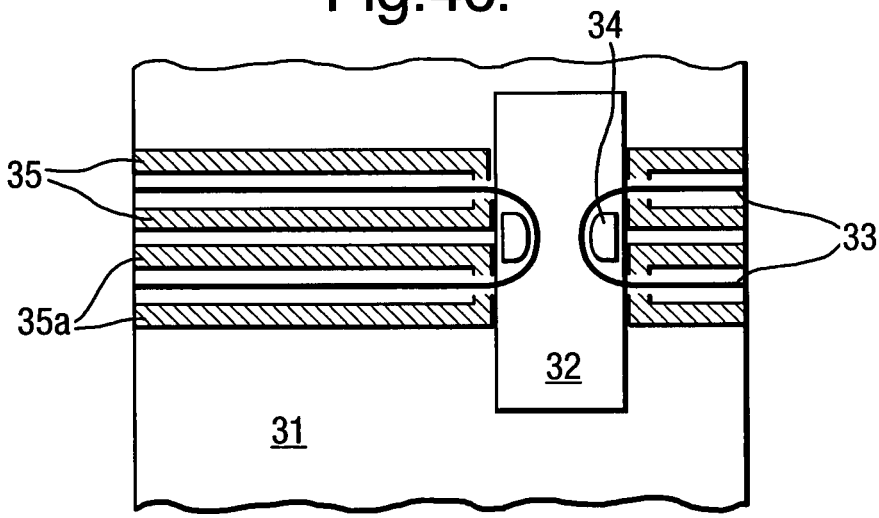

FIG. 4*c* shows a slightly modified set up of FIG. 4*b*, wherein the separate parts of the loop 33 are located in separate housings 35 and 35*a*. The advantage of separating the wires into individual housings is that it creates a wider diameter for the end section of the loop, thus increasing the area of contact with lug 34 and hence reducing the stress exerted on said lug 34. A further advantage is that both housings may cause rupturing of the annulus. A yet further advantage is that one of the housings may incorporate a cutter and the other housing may provide a buckling action or merely a return path for the wire. Alternatively both housings 35 and 35*a* may incorporate a cutter.

Figure 5A:
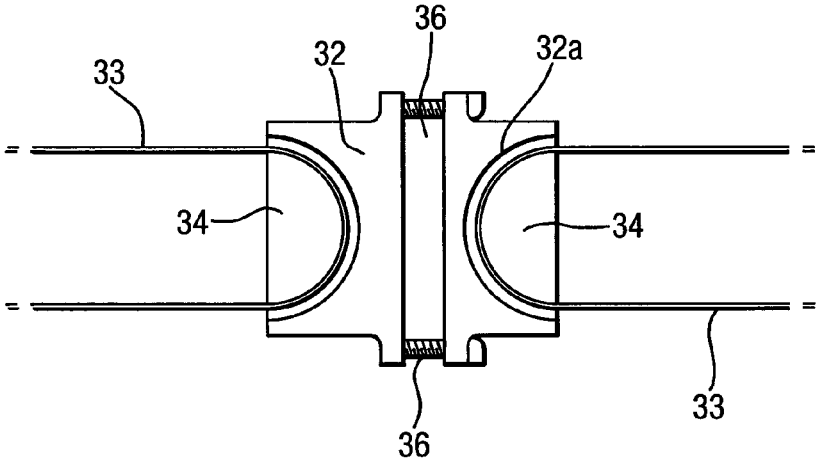

FIG. 5*a* shows a connector formed from two portions 32 and 32*a*, which may be mounted on a munition casing (not shown). There is provided a lug 34 on each portion of the connector 32 and 32*a*, which lugs are designed to retain the loops of shape memory alloy wire 33. The two portions 32 and 32*a* are joined and retained in position by threaded connectors 36. Tension may be imparted by further tightening of said threaded connectors, which also act as tensioners.

Figure 5B:
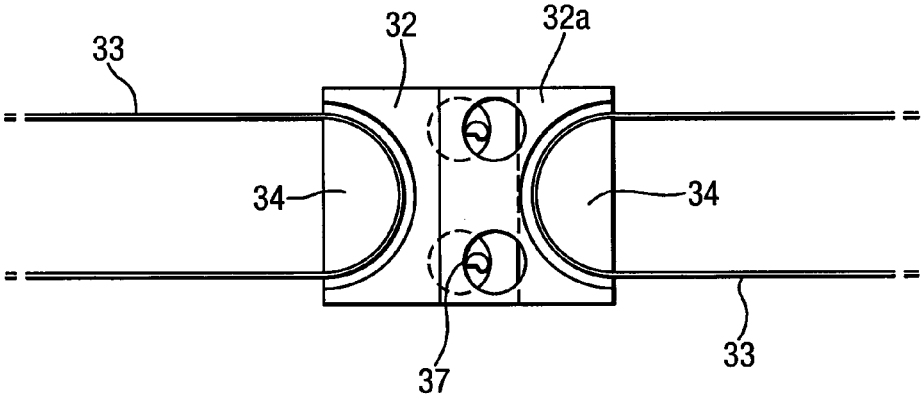

FIG. 5*b* shows a connector formed from two portions 32 and 32*a*, which may be mounted on a munition casing (not shown). There is provided a lug 34, on each portion of the connector 32 and 32*a*, which is designed to retain each loop of shape memory alloy wire 33. The two portions 32 and 32*a* are joined by directly overlapping the said portions. The portions are retained in position by cam arrangement 37. Tension may be imparted by increasing further the degree of overlap, by operation of cam 37, so that the fastening means on the connector is again acting as a tensioner. In both arrangements of FIGS. 5*a* and 5*b*, the fastening means are reversible to allow subsequent detaching of the connecter and hence removal of the annulus from the munition casing.

Figure 5C:
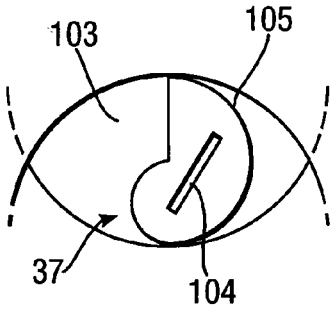

FIG. 5*c* shows an exploded view of the cam 37, and shows a plan view of a cam arrangement 103. The cam 103 may be located on a separate mount as shown in FIG. 5*b* or alternatively it may be directly attached to part of the munition, if so designed (not shown). When the cam 103 is turned by a screw driver via slot 104, the extended radius 105 of the cam moves part 32*a* (in FIG. 5*b*) thereby increasing the degree of overlap between parts 32 and 32*a*, which in turn reduces the overall radius, i.e. applies tension (removes slack) from the shape memory alloy wire 33. Clearly slot 104 may be any shape which is commonly used for fastenings, such as, for example, pozidrive, hexagonal etc.

Figure 6A:
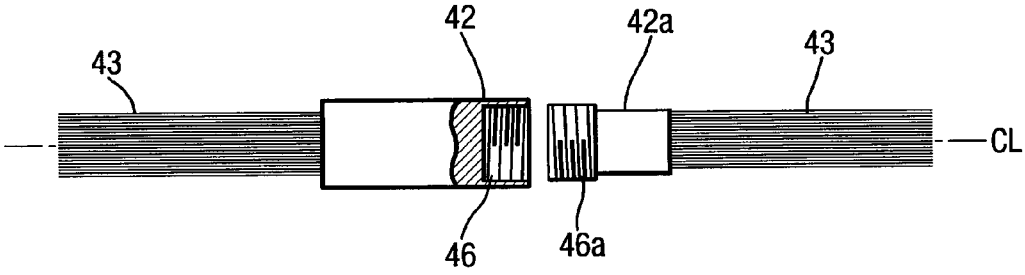

FIG. 6*a* shows a threaded connector, comprising a female connector 42 with an internal thread 46 and a co-operative male connector 42*a* with an external thread 46*a*. The connectors 42 and 42*a* are joined to a plurality of shape memory alloy wires. The wires 43 may be joined to the connectors 42 and 42*a* by any suitable means, such as crimping, clamping, adhesives or welding etc.

Figure 6B:
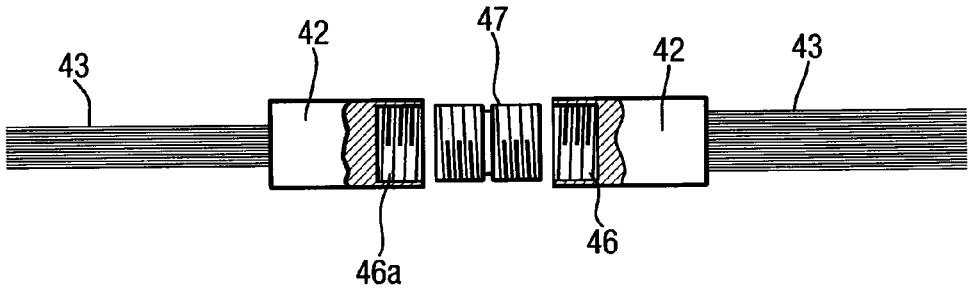

FIG. 6*b* shows a threaded connector comprising two female end sections 42 with internal threads 46 and a co-operative interconnecting middle section 47 with an external (male) thread 46*a* at each of its ends, which operatively locates with internal threads 46. Alternatively, the interconnecting middle section 47 may be a sheath or collar and possess an internal i.e. female thread and the end section 42 possesses a male threaded portion. It may also be convenient for tensioning purposes to use a connector with a right handed thread on one end and a left handed thread on the other.

One advantage of using a threaded connector as the connector, as shown in FIG. 6*a* or 6*b*, is that the joint that is formed is reversible. This is useful when the device needs to be removed such as, for example, before the munition is fired, decommissioned etc. allowing the device to be removed rapidly and if necessary in a confined space. A yet further advantage is that when the connectors comprise screw threads, further tightening may remove excess slack from the formed annulus. In use there may be a number of different length SMA elements which are terminated in a connector either male or female, such that the desired length (i.e. a length which corresponds to the outer surface (circumference) of the munition casing) may be achieved by the appropriate selection of different SMA elements. Conveniently, interconnecting middle sections 47, of the type shown in FIG. 6*b*, may be elongate such as to allow shorter sections of SMA elements to be used.

Figure 7A:
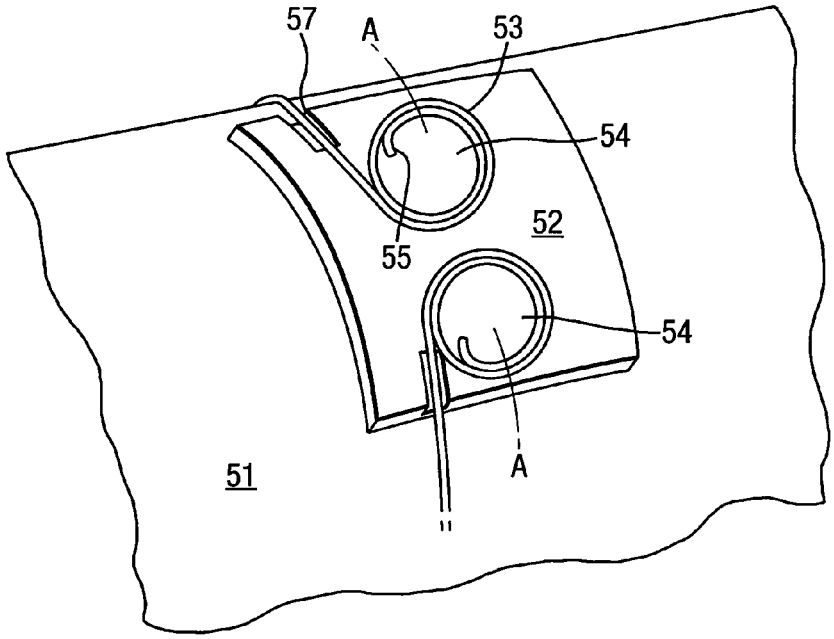

FIG. 7*a* shows a top view of a combined connector and tensioner 52 which is located on a munition casing 51. The tensioner 52 is similar to a capstan or machine head type arrangement. In use a shape memory alloy wire 53 is mechanically wound around a barrel or pillar 54 to gather up excess wire 53. The wire 53 is affixed onto both pillars 54 and tension is imparted into the wire by rotating one or both pillars 54 in opposing directions. The wire 53 is shown as a single thread for simplicity, but may be provided as a plurality of wires as hereinbefore defined. The wire 53 may be optionally located in a housing (not shown) and where a housing is not used it may be advantageous to use a channel or groove 57 in the tensioner 52 to allow for a closer fitting of the wire to the body of the munition (c.f rather than creating a step) to prevent excess pressure being exerted to the edge of the connector 52.

Figure 7B:
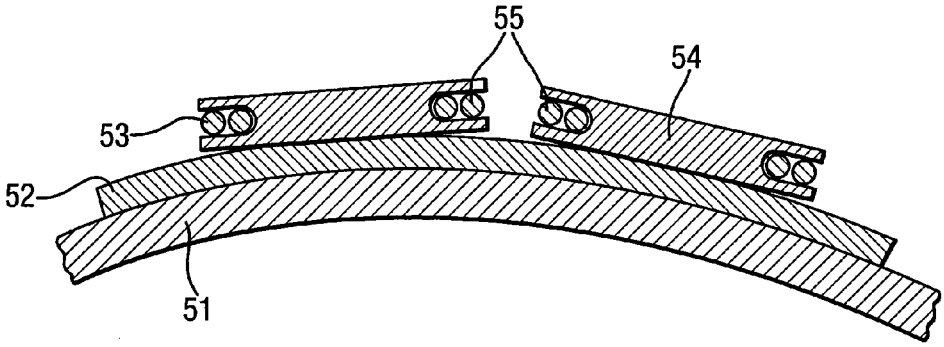

FIG. 7*b* shows a cross section through line A-A of FIG. 7*a*. The wire 53 is retained on the pillar 54 by grooves/walls 55. The pillar 54 may be rotated on a spindle or a threaded screw portion and may be fixed in position, such as for example by a ratchet means, friction from the threaded screw portion, locking nut or adhesive bonding.

Figure 8A:
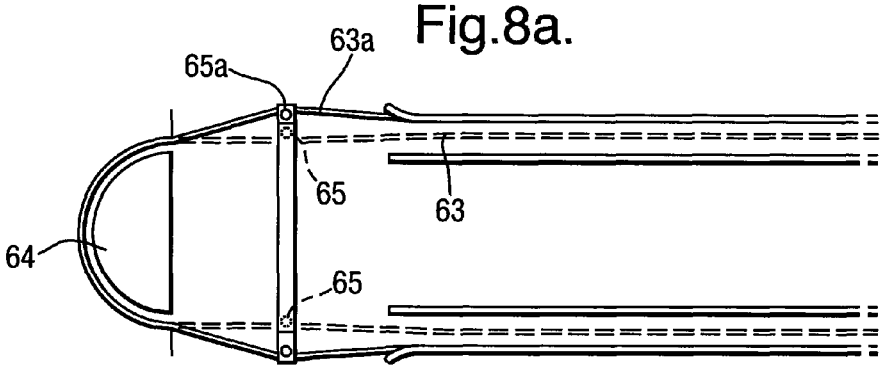

FIG. 8*a* shows a plan view of a wire 63 (dotted line) which is in a first non-tensioned position located on a lug 64 which is part of a connector, similar to the connectors shown in FIGS. 3 and 4. The wire 63, in a first position, is gripped by fixing points 65 on a separate tensioner. The fixing points 65 may then be moved away from the centre line, to a second position 65*a*, such that tension will be imparted to the wire 63*a* (shown as a solid line). This tension will help to retain the connector assembly (shown only in part, by way of lug 64) to the munition casing (not shown) and may remove any excess slack, which may have occurred during the initial fitting of the device to the munition.

Figure 8B:
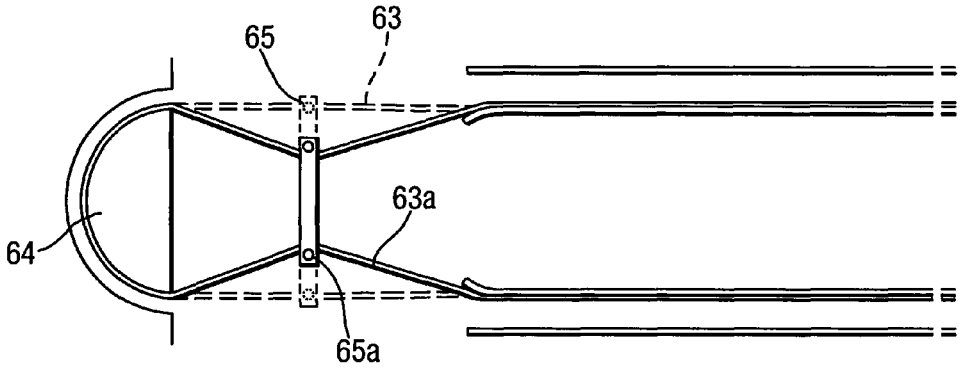

In FIG. 8*b*, in an alternative arrangement, wire 63 (dotted line), in a first non-tensioned position, may be attached to the tensioner via fixing points 65. In this instance, wire 63 may be moved, towards the centre line, to a second position 65*a*, such that wire 63*a* (solid line) is now placed under tension. The remainder of the wire 63, which extends around the munition (not shown) may optionally be located within a housing and optionally may comprise a cutter (not shown).

Figure 9A:
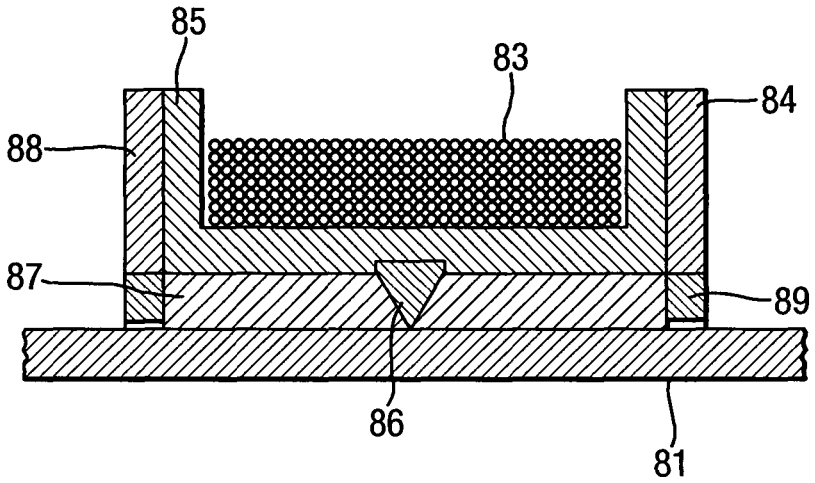

FIG. 9*a* shows a cross section through a cutter 84, which comprises a housing 85, similar to FIG. 2, which contains a plurality of wires 83, The housing 85 has attached to its base at least one cutting edge 86, which is held in a retracted position by a low melt material 87, above the surface of a munition casing 81. The housing is located within a set of guiding walls 88, such that when the shape memory alloy annulus contracts radially inwards the housing 85 is restricted to a substantially linear movement within the guide walls 88. The low melt material 87 may preferably be a low melt alloy, which melts before the temperature of activation of the shape memory alloy of the annulus. At the melting point of the low melt material 87, the molten material may flow out of one or more vent holes 89. The wires 83 may be replaced by a solid or hollow tubular cross sectioned SMA element to form the annulus.

Figure 9B:
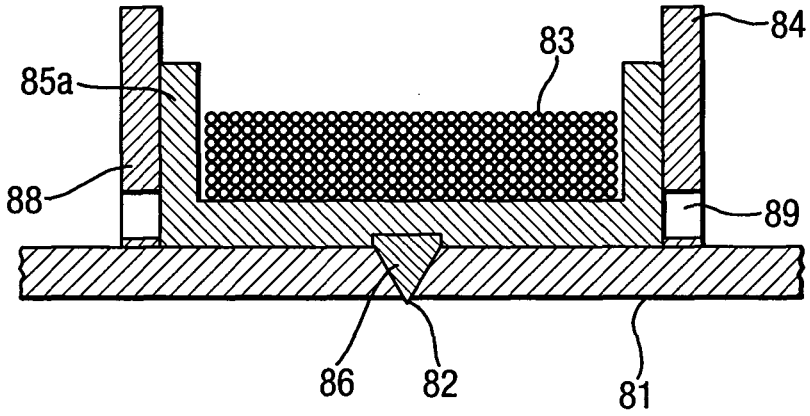

FIG. 9*b*, shows a cross section of the cutter after activation of the shape memory alloy annulus 83. The housing 85*a* has moved radially inwardly towards the casing of the munition 81, forcing the cutting edge 86 to cut through the munition casing 81 to cause an aperture 82, which will allow excess pressure from an otherwise confined energetic material to be released to help mitigate against high order reactions.

Figure 10A:
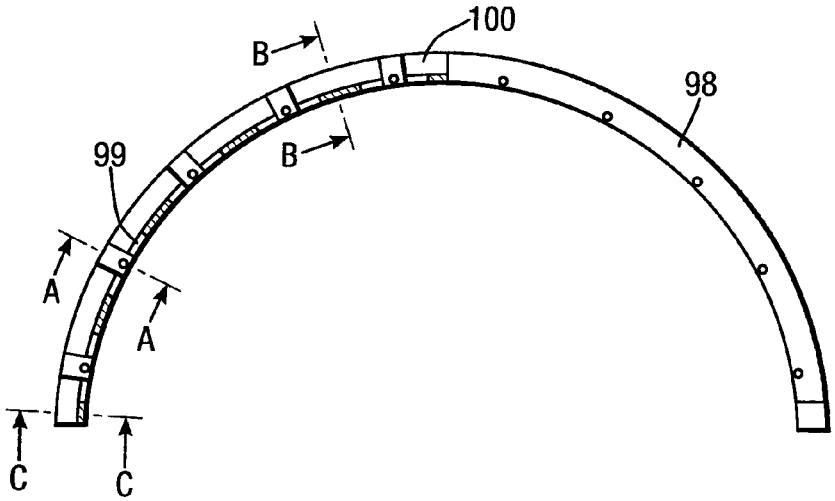

FIG. 10*a* shows a side projection of a combined housing and cutting assembly, comprising wall portions 98 and reinforcement panels 100 to strengthen the assembly in the region of the apertures 99 where the cutting assemblies (not shown) may be mounted.

Figure 10B:
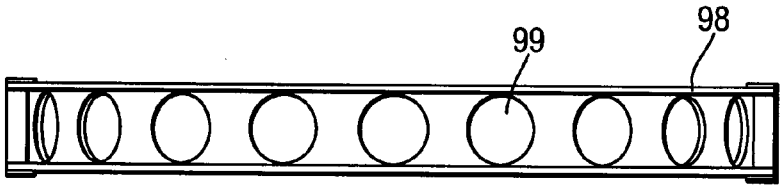

FIG. 10*b* shows the plan view of the combined housing and cutting assembly, the apertures 99 may be any shape and may be regular or elongated. The assembly may also be used without holes or with non cutting blanks (not shown) if buckling is the preferred mechanism for rupturing the munition.

Figure 10C:
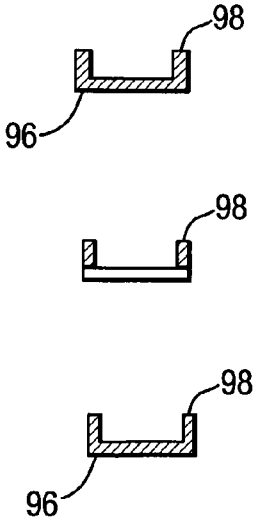

FIG. 10*c* shows the cross section through the wall portions at 98 at points A-A, B-B and C-C of FIGS. 10*a* and 10*b*.

Figure 11:
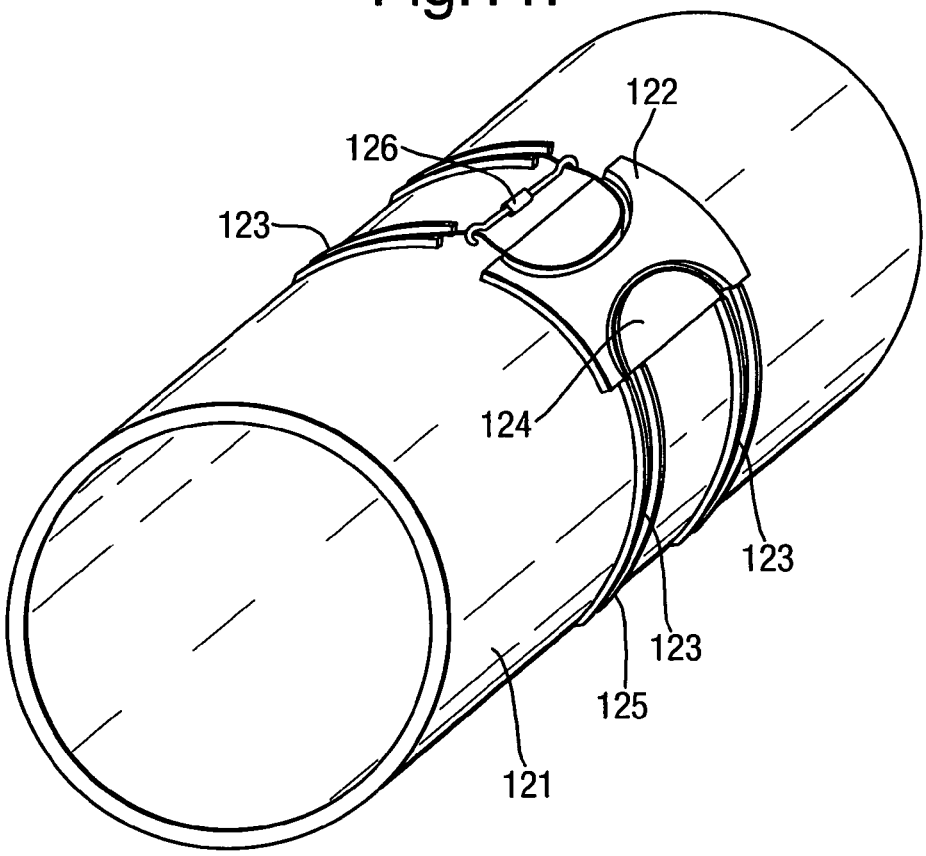
Figure 12A:
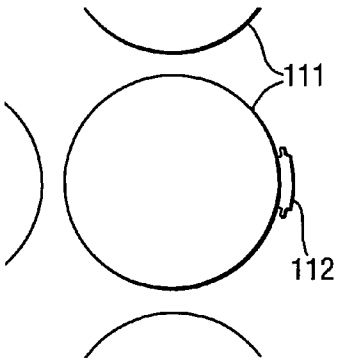
Figure 12B:
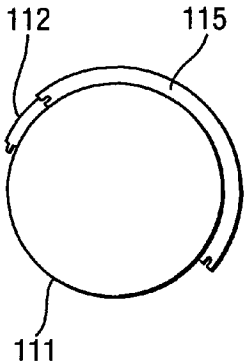
Figure 12C:
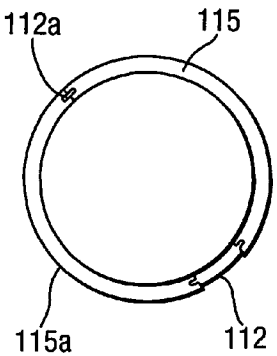
Figure 12D:
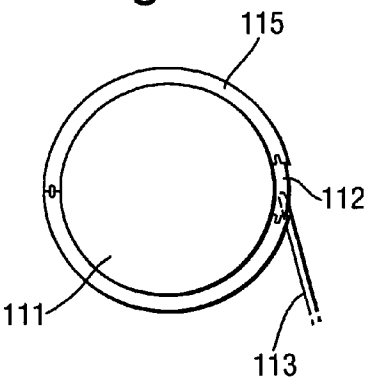
Figure 12E:
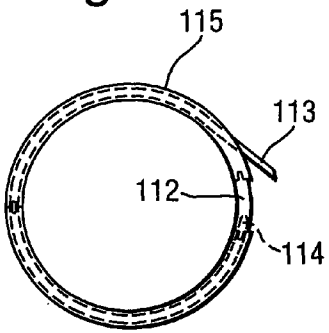
Figure 12F:
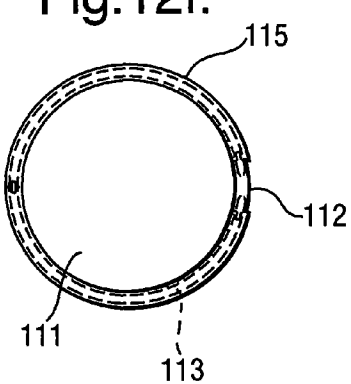

FIG. 11 shows a munition casing 121 with a loop of shape memory alloy 123 being located on a lug 124 which forms part of the connector 122. The loop of wire 123 is located in a housing 125 which runs on the surface of the munition 121. The housing 125 may optionally contain a plurality of cutters (not shown). There is further provided a tensioner 126 which is attached to two parts of the loop 123. Tension is applied by the tensioner 126 by moving the two parts of the loop laterally towards each other.

FIG. 12 shows an end view of a stack of munitions 111, which are to be retrofitted with a device according to the invention. The fitting is made more complicated as adjacent munitions limit user access to the munition to which the device is being fitted. The first step a) is to locate a connector 112, similar to that shown in FIG. 3. The next step b) is to locate a housing 115, which will accommodate the wire (or annulus), on the body of the munition 111. The housing 115 may optionally possess a plurality of cutters as per FIG. 9 (not shown). The next step c) is to add a further housing 115*a*, with optional cutters, on the munition 111 and joining it to the first housing 115 by any convenient joint 112*a*. The joint 112*a* may be a simple clip or threaded connector to merely join the two housings or it may be a further connector means 112. The connector's 112 primary function is to create the annulus for the rupturing device; however, it may also attach one or more sections of housing, where required and such housing and connectors may themselves extend around the entire periphery. In step d) a loop of shape memory allow wire 113 is located on one end of the connector 112, in the next step e) the shape memory alloy wire loop 113 is located within the housing 115 and in step f) the other end of the shape memory alloy wire loop 113 is located onto the connector 112, to form the final annulus.

Figure 13:
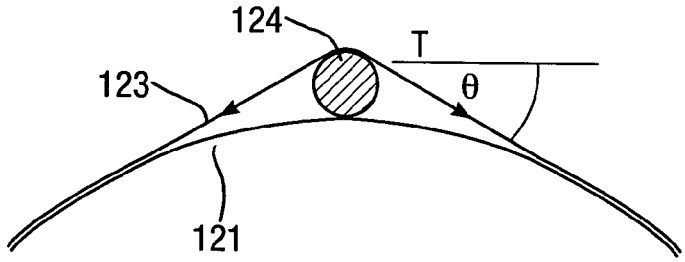

FIG. 13 shows a cross section view of part of a munition case 121, which has located around its exterior surface an SMA wire 123. There is further provided a stress raiser 124, such as, for example, an elongate rod, which is located between the SMA wire 123 and the munition casing 121. When the SMA 123 wire is heated, by any means, to its transition temperature, it will contract along its length causing a reduction in circumference and hence radius of the annulus. This reduction in radius exerts a radially inward force, pulling the rod 124 inwardly and rupturing the casing at the point of contact with the munition case.

In the case of a single stress raiser rod the component of force directed radially inwards is a component of the force exerted by the contracting SMA wire, given by the formula Radial force=2T sin θ, where T is tension in the wire. Advantageously, this force can be exerted at a very precise point, such as, for example a construction joint, such as, for example, a seam or weld joint in a laminated munition case.

Figure 14A:
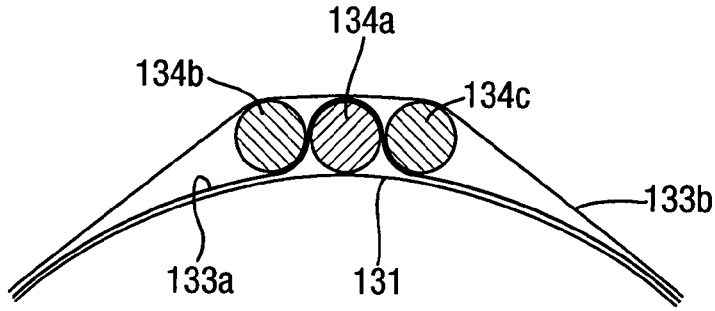
Figure 14B:
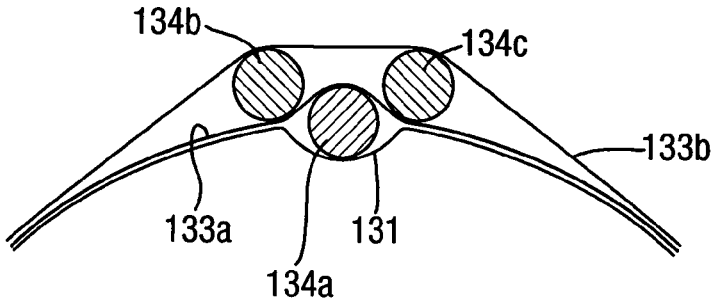

FIGS. 14*a* and 14*b* show an alternative stress raiser configuration comprising the use of 3 or more stress raiser rods. In FIG. 14*a* the rod 134*a* is located between a plurality of SMA wires 133*a* and the munition casing 131, in a similar arrangement to FIG. 13. In addition, two further rods 134*b* and 134*c* are located either side and abutting rod 134*a*. A further plurality of SMA wires 133*b* are then located over all three rods 134*a*, 134*b* and 134*c*. Conveniently, windings 133*a* and 133*b* are merely different portions of windings of the same overall length of SMA wire.

Conveniently, in use, rods 134*a*, 134*b* and 134*c* may be merely slotted in between the wire windings if there is sufficient slack in the original SMA wire annulus, any residual slack may be taken up by a tensioning means as hereinbefore defined.

Turning to FIG. 14*b*, when the SMA wire (i.e. both 133*a* and 133*b*) is heated, by any means, to its transition temperature it will contract along its length causing a reduction in circumference and hence radius of the annulus. The contraction of SMA wire 133*a* causes a force to be exerted on rod 134*a* pulling it inwardly onto the casing at the point of contact with the munition case. The portion of SMA wire 133*b* exerts its force on both rods 134*b* and 134*c* pulling them inwardly onto the rod 134*a*, thereby forcing rod 134*a* further into the munition.

To increase the radial force exerted by a stress raiser on the casing, requires either more wire to increase T, with associated mass and cost penalties, or increasing θ, which implies a thicker rod. Whilst a thicker rod may be simple to implement, the device may impinge on nearby munitions or on the casing of an associated launch tube.

Three variables that may be used to optimise the device are (i) the size of the rods in relation to the diameter of the casing, (ii) the proportions of SMA wire deployed in the inner 133*a* and outer 133*b* windings and (iii) the size of the subsidiary rods 134*b* and 134*c* in relation to the central rod 134*a*

In the 3 rod arrangement, the effective value of θ becomes 90°, the peak driving force can be maintained throughout a greater radial displacement, albeit at a lower average level.

Comparing the single rod device in FIG. 13 with the three rod arrangement in FIG. 14, the work the wires are capable of doing, i.e. the integral of force versus displacement, is similar between the two devices. However, the three rod arrangement gives a greater total radial inward displacement and additionally the peak driving force occurs at a later stage in the activation. Therefore, for venting a steel rocket motor case, the single rod of FIG. 13, may be more suitable because as the rod is driven in, the resistive force increases rapidly, so a large initial force is needed to overcome it.

Whereas, the three rod configuration may offer an advantage for overwound motor cases, such as, for example, a dry aramid overwound aluminium alloy case. The central rod presses initially into a compliant substrate, i.e. overwind, and then has to overcome the extensive elongation of the aluminium alloy. Under these circumstances an initial large driving force is unnecessary, while an enhanced "stroke" is more use, i.e. a longer more sustained force is desirable.

The SMA wires may be pinched between the respective rods in the three rod arrangement; in order to mitigate against damage of the wires, it may be desirable to have grooves or channels in the rods so that the SMA wire windings can run through them.

Figure 15A:
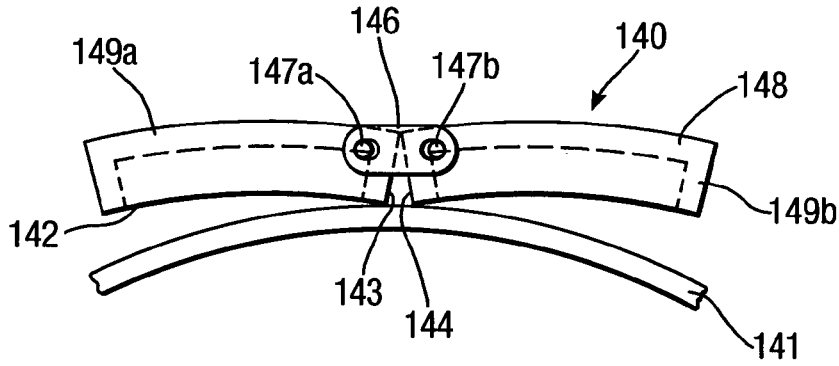
Figure 15B:
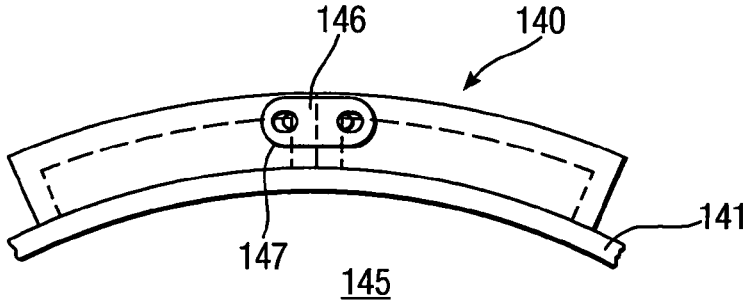

FIGS. 15*a* and 15*b* show cross sections of a hinged housing 140 being arranged on a munition 141. The housing 140 contains individual housing elements 149*a* and 149*b*, which are small discrete sections (and are similar in nature to those shown in the above figures) and possess walls 148 and a base section 142 to retain the SMA wires (not shown) and optionally cutters (also not shown). The sections 149*a* and 149*b* are linked to together via a hinge 146, which is fixed to the walls 148 via pivot points 147*a* and 147*b*, which allow rotation of housing elements 149*a* and 149*b* about the hinge 146. The housing sections 149*a* and 149*b* possess adjacent edges 143 and 144 respectively which in one arrangement, such as in FIG. 15*b*, may close to form an abutted join 145. In an alternative arrangement the hinge 146 may be elongate, such that there is a gap between 143 and 144.

Typically there are a plurality of housing sections which are linked together to create a bracelet type arrangement, which allows for a more flexible housing arrangement about the munition 141. The shape of the base sections 142 may preferably be arcuate particularly when the housing sections 149*a* and 149*b* are also elongate, i.e. to allow the base section 142 to be follow the contour of the curved surface of the munition. However if the housing sections 149*a* and 149*b* are relatively short then the curvature of the arc may be minimal or even substantially flat. It is preferable that the housing (and thus individual housing elements) sit in close abutment with the external surface of the munition so that the SMA wire does not have to deform a poorly fitted housing arrangement.

Figure 16:
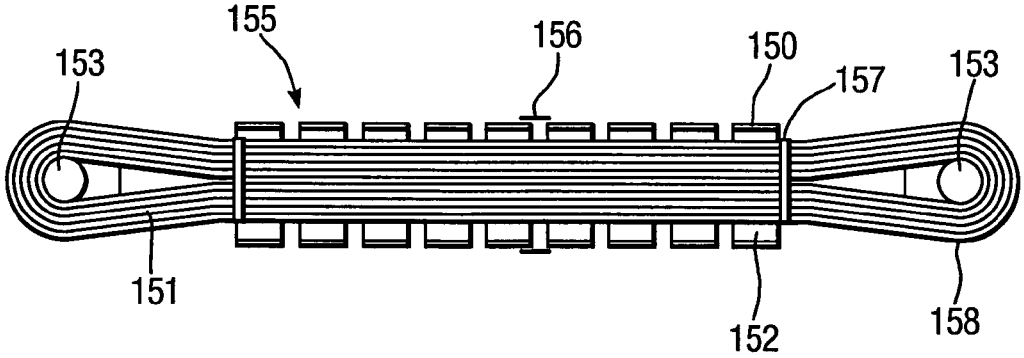
FIG. 16 shows a top view of SMA wire windings located in the hinged housing arrangement of FIG. 15*a*.

FIG. 16, shows a top view of SMA wire windings 151 in the form of an extended loop, which is located in a linked housing elements 155. The elements 155 are each formed of walls 150 and a base section 152. The housing elements 155 are linked by way of a hinge 156 in a manner shown in FIGS. 15*a* and 15*b*. The ends of the SMA wire windings 153 are brought together and held in place by a retaining clip 157 to retain said loop of SMA wire windings and create an end section of loop 158, which fits around lugs 153. The lugs 153 may conveniently form part of a connector (not shown) so as to form the final annulus.

Figure 17:
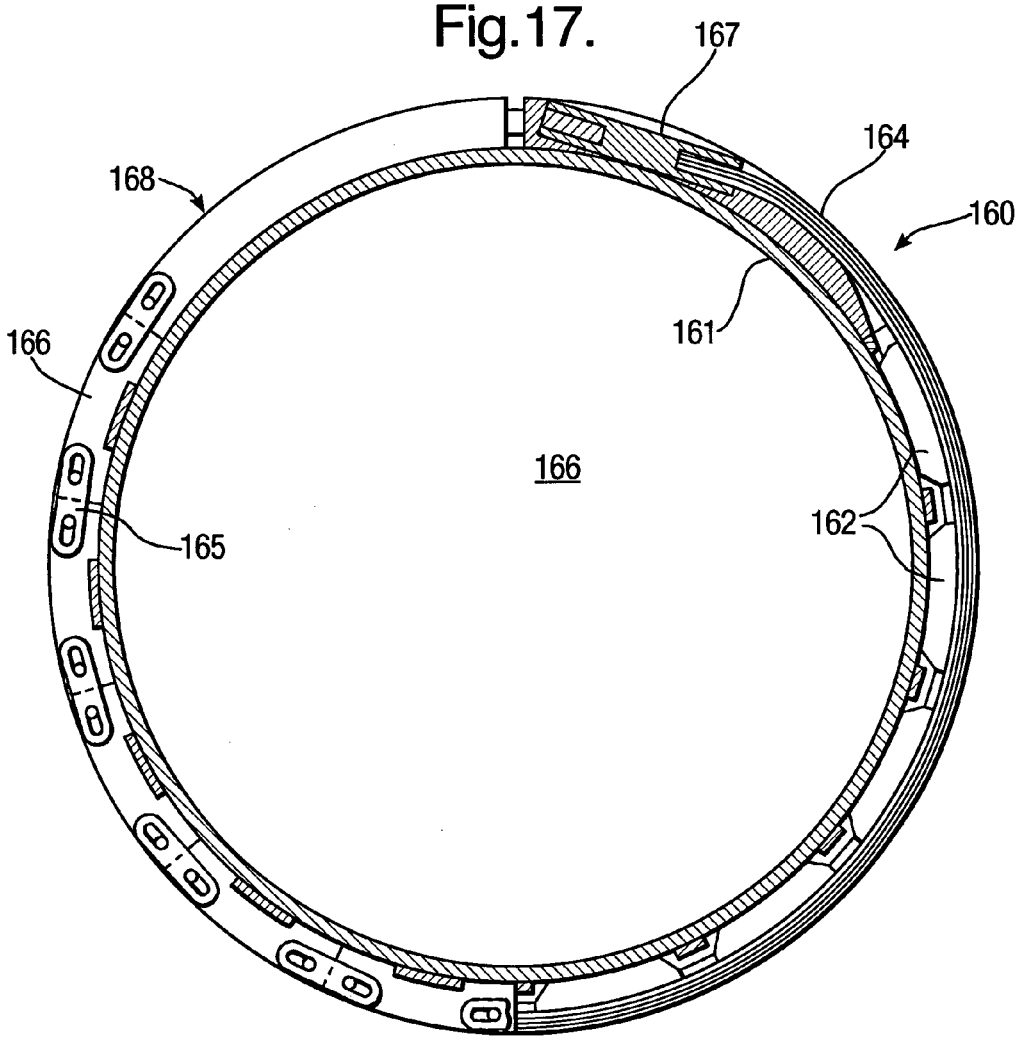
FIG. 17 shows a combined side view and cross section view of a cutter device arranged on a munition.

FIG. 17 shows a side view and cross section of a bracelet type cutting device 160, in a closed configuration. The housing is formed of a plurality of housing elements 166, which are linked via hinges 165, to form a circular housing arrangement 168 located on the external wall 161 of a munition 166. The cross section aspect of the figure reveals the SMA wire windings 164 which pass over a plurality of cutters 162 and the ends of the SMA wire windings are connected to a lug of the connection means 167. The bracelet in its open formation may be readily located around the munition with the SMA wires and cutters already located in the correct orientation and then closed via the connector to form the closed device 160.

The invention further provides a novel feature or any combination of novel features as identified above.

The invention claimed is:

1. Equipment comprising a casing, hollow tubular body or container and a rupturing device suitable for rupturing the casing, hollow tubular body or container, the rupturing device comprising at least one shape memory alloy (SMA) element which is connectable by at least one connector to form an annulus, wherein said shape memory alloy has been subjected to a combination of mechanical and thermal treatments and has a selected composition such that upon subsequent heating, in use, to a predetermined temperature, said annulus contracts along its length to provide a rupturing function, wherein the device is mounted around a periphery of said casing, hollow tubular body or container, and is connected to form said annulus and is adapted such that upon subsequent heating, in use, said annulus contracts inwardly to rupture said casing, hollow tubular body or container, wherein the SMA element is itself a loop or coil of a plurality of shape memory alloy wire windings having two loop ends, which are connectable by said connector disposed between the two loop ends.

2. Equipment according to claim 1, wherein the connector comprises at least one operative part and at least one co-operative part that are connectable together and that are each integrally provided at the respective ends of the SMA element.

3. Equipment according to claim 2, wherein the connector is disengageable to allow said annulus to be broken.

4. Equipment according to claim 1, wherein the connector comprises a shape memory alloy.

5. Equipment according to claim 1, wherein at least two connectors and at least two SMA elements are connectable to form said annulus.

6. Equipment according to claim 1, wherein there are at least two respective SMA elements which are connectable by a single elongate connector at two respective spaced positions along said connector's length to form two respective annuli spaced from one another.

7. Equipment according to claim 1, wherein the casing, hollow tubular body or container is a munition casing, or a launch-tube or platform for a munition.

8. A munition casing, or a launch-tube or platform for a munition wherein there is provided one or more devices according to claim 1.

9. A rupturing device suitable for rupturing a casing, hollow tubular body or container, comprising at least one shape memory alloy (SMA) element which is connectable by at least one connector to form an annulus, wherein said shape memory alloy has been subjected to a combination of mechanical and thermal treatments and has a resulting composition such that upon subsequent heating, in use, to a predetermined temperature, said annulus contracts a predetermined amount along its length to provide a rupturing function, wherein the SMA element is itself a loop or coil of a plurality of shape memory alloy wire windings having two loop ends, which are connectable by said connector disposed between the two loop ends.

10. A device according to claim 9, wherein the connector comprises at least one operative part and at least one co-operative part that are connectable together and that are each integrally provided at the respective ends of the SMA element.

11. A device according to claim 9, wherein the connector comprises two end sections that are each integrally provided at the respective ends of the SMA element and an interconnecting middle section having respective end portions that are connectable to said respective two end sections to form said annulus.

12. A device according to claim 10, wherein the connector is disengageable to allow said annulus to be broken.

13. A device according to claim 9, wherein the connector comprises a shape memory alloy.

14. A device according to claim 9, wherein at least two connectors and at least two SMA elements are connectable to form said annulus.

15. A device according to claim 9, wherein there are at least two respective SMA elements which are connectable by a single elongate connector at two respective spaced positions along said connector's length to form two respective annuli spaced from one another.

16. A rupturing device suitable for rupturing a casing, hollow tubular body or container, comprising at least one shape memory alloy (SMA) element which is connectable by at least one connector to form an annulus, wherein said shape memory alloy has been subjected to a combination of mechanical and thermal treatments and has a resulting composition such that upon subsequent heating, in use, to a predetermined temperature, said annulus contracts a predetermined amount along its length to provide a rupturing function, wherein there are at least two respective SMA elements which are connectable by a single elongate connector at two respective spaced positions along said connector's length to form two respective annuli spaced from one another.

17. Equipment comprising a casing, hollow tubular body or container and a rupturing device suitable for rupturing the casing, hollow tubular body or container, the rupturing device comprising at least one shape memory alloy (SMA) element which is connectable by at least one connector to form an annulus, wherein said shape memory alloy has been subjected to a combination of mechanical and thermal treatments and has a selected composition such that upon subsequent heating, in use, to a predetermined temperature, said annulus contracts along its length to provide a rupturing function, wherein the device is mounted around a periphery of said casing, hollow tubular body or container, and is connected to form said annulus and is adapted such that upon subsequent heating, in use, said annulus contracts inwardly to rupture said casing, hollow tubular body or container, wherein there are at least two respective SMA elements which are connectable by a single elongate connector at two respective spaced positions along said connector's length to form two respective annuli spaced from one another.

* * * * *